US007415847B1

(12) United States Patent
Ho

(10) Patent No.: US 7,415,847 B1
(45) Date of Patent: Aug. 26, 2008

(54) WASHING MACHINE

(76) Inventor: Myong H Ho, 356 Warren Blvd., Broomall, PA (US) 19008

( * ) Notice: Subject to any disclaimer, the term of this patent is extended or adjusted under 35 U.S.C. 154(b) by 694 days.

(21) Appl. No.: 10/858,398

(22) Filed: Jun. 2, 2004

(30) Foreign Application Priority Data

Feb. 9, 2004 (KR) ..... 20-2004-0003133 U

(51) Int. Cl.
*D06F 29/00* (2006.01)

(52) U.S. Cl. ..... 68/12.18; 68/12.01; 68/12.19; 68/13 R

(58) Field of Classification Search ..... 68/20, 68/12.02, 12.01, 12.18, 12.19, 13 R
See application file for complete search history.

(56) References Cited

U.S. PATENT DOCUMENTS 5,207,764 A * 5/1993 Akabane et al. ..... 68/20
5,853,014 A * 12/1998 Rosenauer ..... 134/102.1
5,960,501 A * 10/1999 Burdick ..... 8/158
6,153,151 A * 11/2000 Moxley et al. ..... 422/186.07
6,250,118 B1 * 6/2001 Kim ..... 68/17 R
6,272,770 B1 * 8/2001 Slutsky et al. ..... 34/596
6,845,569 B1 * 1/2005 Kim ..... 34/106
2002/0062667 A1 * 5/2002 Ahmad ..... 68/12.12

* cited by examiner

*Primary Examiner*—Michael Barr
*Assistant Examiner*—Jason Heckert
(74) *Attorney, Agent, or Firm*—Robert E. Bushnell, Esq.

(57) ABSTRACT

A washing machine has a washing water supplier which includes a storage tank storing washing water and a cooler decreasing a temperature of the washing water supplied from the storage tank and a washing tub. The washing water storage apparatus keeps the temperature of the washing water low by circulating the washing water of the storage tank through the cooler. The washing tub is connected to the washing water supplier to receive the washing water supplied from the storage tank and use the washing water to wash laundry. A washing machine can use ozone micro-bubbles. Ozone micro-bubbles are generated for easy disinfection and sterilization, without using any high-pressure rotation pump. After the ozone is generated in an ozone generation apparatus, the ozone forms a water-ozone mixture in an ozone mixing unit. The mixture is atomized into micro-bubbles in the rotation pump and returns to the washing tub.

1 Claim, 9 Drawing Sheets

WASHING MACHINE

BACKGROUND OF THE INVENTION

1. Field of the Invention

The present invention relates to a washing machine, and more particularly to a washing machine incorporating washing, draining, and drying functions at the same time.

2. Description of the Prior Art

Conventional washing machines have problems as follows:

Firstly, there is much variation in efficiency, when draining and drying laundry, according to its location within a washing tub. For example, when washing and draining processes have just ended, the laundry contains more moisture where it contacts the inner surface of the washing tub than where it is adjacent to the rotation shaft of the washing tub. Accordingly, the laundry needs mixing before drying.

In addition, since the draining process mainly depends on centrifugal force, which is caused by the rapid revolution of the washing tub, it takes much time for the laundry to recover from a wrinkled state, which has resulted from the revolution.

Besides, since the protrusion member of the washing tub has no hole, the draining process is inefficient. Furthermore, since the laundry is dried with unconditioned air within the washing tub, the drying process is also inefficient.

The present invention is also directed to a washing machine, more strictly, a washing machine capable of using ozone micro-bubbles for washing.

In general, a washing machine rubs laundry with an aqueous solution of a detergent, in particular a surfactant, so that dirt is removed from the laundry due to the activity of the surfactant.

More particularly, the surfactant uses its penetration, emulsification, and dispersion functions to change the surface tension of water, fibers, and dirt so that dirt is removed from the fibers.

However, if such a surfactant is used, it may be drained and cause eutrophication of rivers. Furthermore, since surfactant cannot disinfect germs which breed in clothes, the laundry should be disinfected separately before and after washing.

In an attempt to overcome the above-mentioned problems, a washing machine has been developed which uses ozone.

A conventional ozone washing machine wherein, contrary to conventional washing machines which use a pulsator to generate eddy currents of water and air bubbles for enhanced decomposition of a detergent and for improved washing effect, ozone gas replaces air and is blown into a washing tub for enhanced decomposition of the detergent, improved washing effect, decreased water contamination, and disinfection of germs which breed in clothes.

However, such a washing machine, which has an ozone generator, cannot provide a satisfactory washing effect, because the ozone is not dissolved in washing water with high efficiency.

Meanwhile, it has been proposed to generate air bubbles so that the saponification of washing water is accelerated and the laundry is subject to physical force, which is caused by the air bubbles, for an improved washing action. However, the air bubbles tend to rise to the surface, rather than contact the laundry, because of their big size. Since the laundry cannot contact the air bubbles for a long period of time, the washing action is limited.

In order to overcome this, a washing machine has been developed which uses micro-bubbles.

The micro-bubbles refer to minute bubbles, which are considerably smaller than conventional air bubbles, so that they strongly adhere to the surface of laundry and thus seldom rise to the surface rapidly and disappear. In other words, the micro-bubbles stay in the washing water for a long period of time and strongly maintain the bubble state. Once they adhere to the laundry, they are not easily separated from it.

Korean Patent Application No. 1996-55,685 (the contents of which are hereby incorporated by reference) discloses a conventional micro-bubble type washing machine wherein a washing tub having a pulsator is rotated by a motor in a draining tub having a heater, for washing action. The washing machine comprises: a door hermetically mounted on the washing and draining tubs via packing; an air tube having an end connected to a holding portion of the door by a tubing; a vacuum pump connected to the other end of the air tube; an air cut-off valve hermetically connected to the air tube; an input switch mounted on the holding portion of the door; and a control panel which is adapted to open the air cut-off valve, turn the vacuum pump on, and operate the heat until it receives a predetermined input from the input switch.

Such a micro-bubble type washing machine is made by adding a pressure reducer, which generate a predetermined vacuum pressure, to a fully automatic washing machine, which boils and dries laundry. Accordingly, the washing machine can shorten the time for boiling and drying the laundry, as well as improve the washing action by using micro-bubbles.

However, the micro-bubbles themselves can perform neither disinfection nor sterilization, because they are made of air. Therefore, they have only a physical washing effect but no chemical washing effect. Besides, the micro-bubbles are generated in a vacuum state under an interlock with a pulsator. This is a complicated process.

SUMMARY OF THE INVENTION

Accordingly, the present invention has been made to solve the above-mentioned problems occurring in the prior art, and an object of the present invention is to provide a washing machine having improved washing, draining, and drying efficiencies.

Another object of the present invention is to provide a washing machine wherein washing water flows into its washing tub under control so that it can provide more powerful washing function.

Another object of the present invention is to provide a washing machine wherein the structure of its washing tub protrusion member is adapted and the air within its washing tub is conditioned for more powerful draining and drying functions.

Another object of the present invention is to provide a washing machine wherein micro-bubbles for use in washing are easily generated using ozone, without any separate air-bubble generator as in the prior art.

Another object of the present invention is to provide a washing machine wherein a water-ozone mixture, which includes ozone, is created and transferred through a pump to generate ozone micro-bubbles.

Another object of the present invention is to provide a washing machine wherein ozone is mixed, before pressurization, to create micro-bubbles so that the micro-bubbles are generated without any additional component.

In order to accomplish this object, there is provided a washing machine comprising: a washing water supply means for supplying washing water to a washing tub and a washing tub which is connected to the washing water supply means and is composed of a washing apparatus for washing laundry, a draining apparatus for draining the washed laundry, and a drying apparatus for drying the drained laundry.

The washing water supply means includes: an auxiliary storage tank which is connected to a tap water pipe and is adapted to preferentially receive washing water from the tap water pipe and store it; a washing tub lead-in apparatus which is connected to the washing tub and is adapted to control the amount of washing water flowing into the washing tub; and a washing water storage apparatus which is adapted to supply the washing water to the washing tub lead-in apparatus and which connects the auxiliary storage tank with the washing tub lead-in apparatus.

The washing water storage apparatus includes: a leveling apparatus which is connected to the auxiliary storage tank and is adapted to adjust the amount of washing water flowing from it; a storage tank which is connected to the leveling apparatus and is adapted to store the washing water which has passed through it; a quick cooler which is connected to the storage tank and is adapted to decrease the temperature of the washing water from ambient temperature to 4° C.; a magnetic field mixer which is connected to the quick cooler and is adapted to endow the washing water with polarity; an ozone generator for generating ozone; an ozone mixer connected to both the ozone generator and the magnetic field mixer to mix the ozone having emerged from the ozone generator with the washing water having passed through the magnetic field mixer into a water-ozone mixture; and a rotation pump means which is connected to the ozone mixer and is adapted to atomize the ozone of the water-ozone mixture with its internal rotor or impeller to create micro-bubbles.

According to another aspect of the present invention, there is provided a washing machine using ozone micro-bubbles comprising: an ozone generation apparatus for generating ozone; a washing tub for containing washing water and laundry; an ozone mixing unit for mixing the ozone from the ozone generation apparatus with the washing water into a water-ozone mixture; and a rotation pump means for atomizing the ozone of the water-ozone mixture with its internal rotor or impeller to create micro-bubbles.

The washing machine further comprises: a pressure sensing unit connected to a pressure sensor for sensing the pressure of the water-ozone mixture, which has passed through the rotation pump means; a switching valve for opening/closing a tube, which connects the ozone generation apparatus with the ozone mixing unit; and a pressure control means for receiving a pressure input from the pressure sensor and controlling the opening/closing of the switching valve.

The washing machine further comprises: a pressure maintenance tank positioned between the rotation pump means and the pressure sensing unit to store the water-ozone mixture temporarily.

The pressure sensing unit is connected with an air discharge tube.

The pressure control means is adapted to open the switching valve, if the pressure sensed by the pressure sensing unit reaches a predetermined pressure, so that the ozone flows in, and to close the switching valve, if the pressure sensed by the pressure sensing unit does not reach a predetermined pressure, so that the ozone does not flow in.

The predetermined pressure is in the range of 6-6.5 kgf/$cm^2$.

The ozone generation apparatus is connected with a small pump so that generated ozone can be pressurized.

The washing machine further comprises a filtering means for removing alien substances from the washing water, which is connected to the ozone mixing unit to filter the washing water flowing into it.

The washing tub has a shaft coupler positioned on each of its opposite sides, which can be rotated by a motor and is fitted with a rotational brush of a cylindrical shape.

The washing tub has a washing tub protrusion member fastened thereon and the member has a hole on its surface, which is in connection with the draining apparatus or the drying apparatus of the washing tub.

The washing tub further includes: an air circulation apparatus for circulating the air within the washing tub and an extraction apparatus for extracting the moisture within the washing tub to the exterior.

The washing tub further includes a low-frequency wave generation apparatus for generating low-frequency waves or microwaves and applying them to the air within the washing tub.

The washing apparatus and the draining apparatus are configured as a washing tub, which is separate from the drying apparatus.

The washing tub further includes an anion generation apparatus.

The washing tub has a washing water circulation apparatus coupled on its external surface, which circulates water of 4° C. around the outside of the washing tub to cool it.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
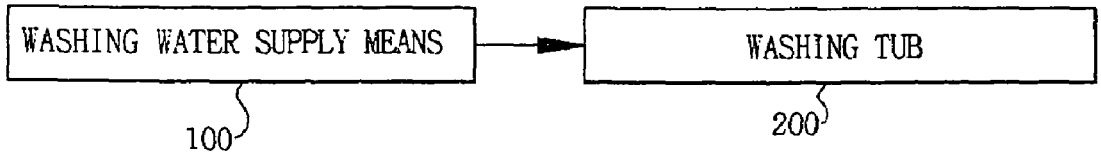
FIG. 1 shows the overall construction of a washing machine according to the present invention.

Hereinafter, a preferred embodiment of the present invention will be described with reference to the accompanying drawings. In the following description and drawings, the same reference numerals are used to designate the same or similar components, and so repetition of the description on the same or similar components will be omitted.

FIG. 1 shows the overall construction of a washing machine according to the present invention.

Referring to FIG. 1, a single washing machine includes a washing water supply means 100, a washing apparatus, a draining apparatus, and a drying apparatus therein. In particular, a single washing tub 200 is composed of a washing apparatus, a draining apparatus, and a drying apparatus.

Figure 2:
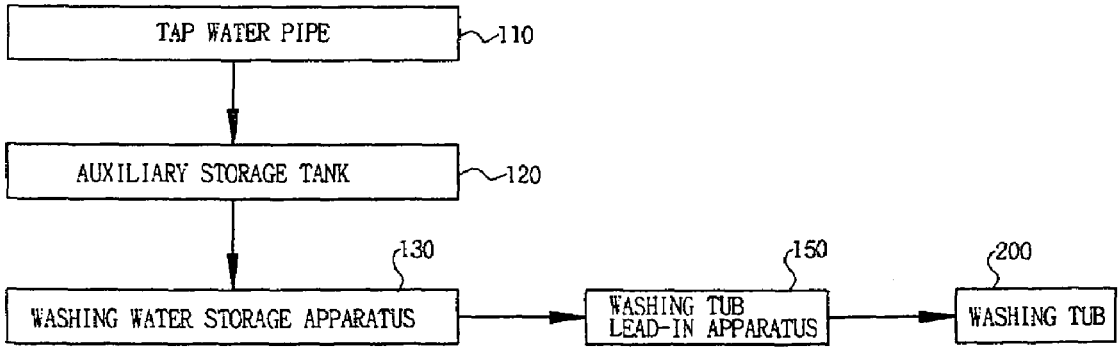
FIG. 2 shows the construction of a washing water supply means according to the present invention.

FIG. 2 shows the construction of a washing water supply means 100 according to the present invention.

Referring to FIG. 2, washing water is supplied from a tap water pipe 110 and passes through an auxiliary storage tank 120, a washing water storage apparatus 130, a washing tub lead-in apparatus 150, and a washing tub 200 successively. The auxiliary storage tank 120 maintains the flow rate of the washing tub, which flows from the washing storage apparatus 130 to the washing tub 200.

After leaving the washing water storage apparatus 130, the washing water passes through the washing tub lead-in apparatus 150, which is the entrance of the washing tub 200, and enters the washing tub 200 to perform a washing function.

Figure 3:
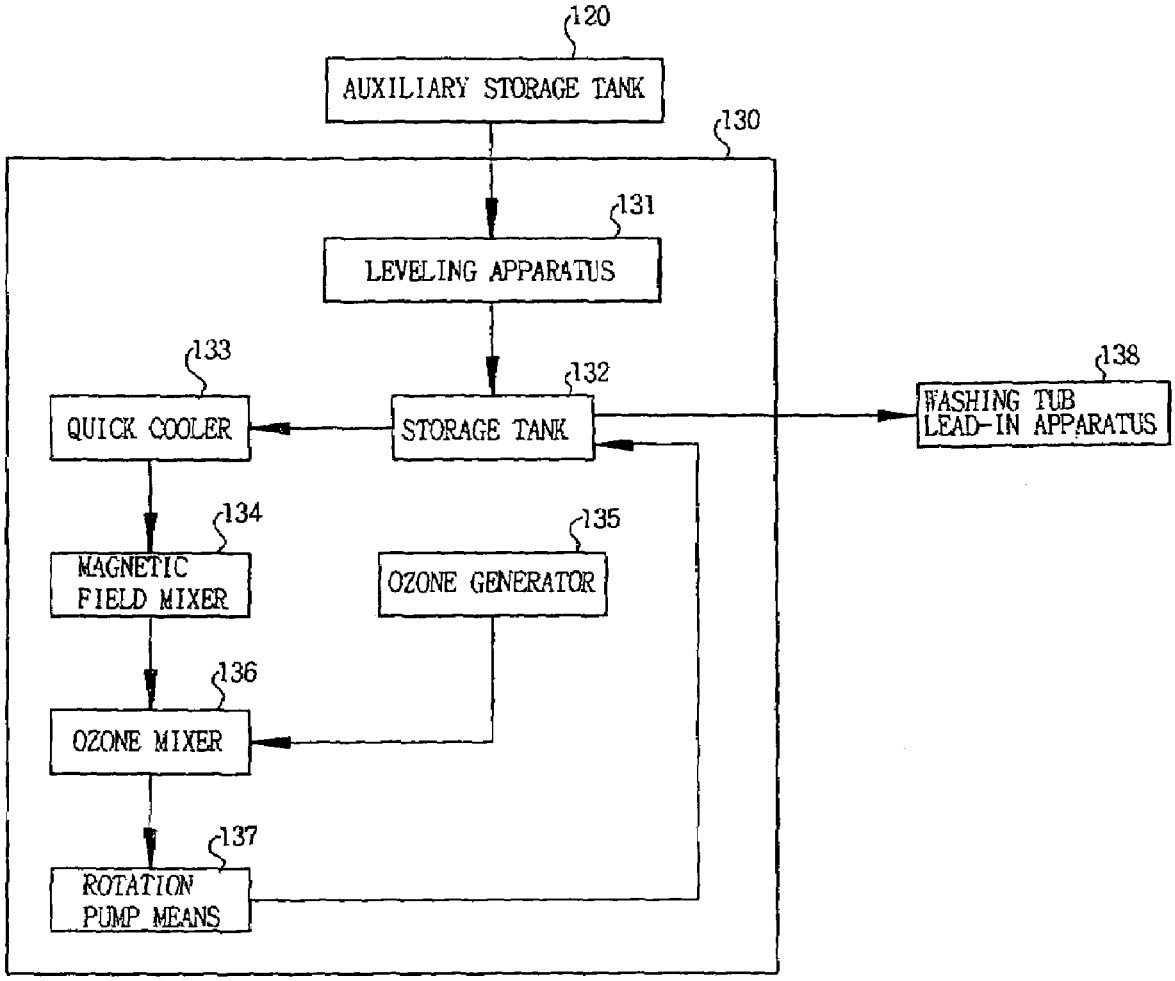
FIG. 3 shows the construction of a washing water storage apparatus according to the present invention.

FIG. 3 shows the construction of a washing water storage apparatus according to the present invention:

Referring to FIG. 3, the washing water storage apparatus 130 is composed of a plurality of apparatuses. A leveling apparatus 131 is connected to the auxiliary storage tank 120 and controls the amount of washing water which flows from the auxiliary storage tank 120. After passing through the leveling apparatus 131, the washing water flows into a storage tank 132. The storage tank 132 is connected with the leveling apparatus 131. The storage tank 132 is also connected with a quick cooler 133 and the quick cooler 133 is connected with a magnetic field mixer 134. After exiting the storage tank 132, the washing water passes through the quick cooler 133 and the magnetic field mixer 134. The washing water is then optimized for washing.

The quick cooler 133 decreases the temperature of the washing water, which is generally ambient temperature, to 4° C., in order to maximize the density among water molecules. This is because the maximum density of water occurs at 4° C.

The washing water then passes through the magnetic field mixer 134, which endows the washing water with polarity. After the washing water has passed through the magnetic field mixer 134 as well as the quick cooler 133 the polarized water molecules have their maximum number per unit volume. As a result, the washing function is considerably enhanced and the washing time is drastically shortened.

After exiting the magnetic field mixer 134, the washing water is mixed with ozone having been generated by an ozone generator 135 in an ozone mixer 136, creating a water-ozone mixture. The reason ozone is mixed with water is as follows:

In general, a washing machine agitates laundry with an aqueous solution of a detergent, in particular a surfactant, so that dirt is removed from the laundry due to the activity of the surfactant. More particularly, the surfactant uses its penetration, emulsification, and dispersion functions to change the surface tension of water, fibers, and dirt so that dirt is removed from the fibers.

However, if such a surfactant is used, it may be drained and cause eutrophication of rivers. Furthermore, since the surfactant cannot disinfect germs which breed in clothes, the laundry should be disinfected separately before and after washing.

Meanwhile, the water-ozone mixture is generally used to wash heavily stained laundry. Accordingly, if ozone is not needed for washing, the ozone generator 135, the ozone mixer 136, and the rotation pump means 137 may be omitted from the construction of FIG. 3. In other words, the washing water may directly flow into the storage tank 132, after passing through the magnetic field mixer 134, when ozone is unnecessary.

If the water-ozone mixture is necessary for washing, it flows from the ozone mixer 136 to the rotation pump means 137. The rotation pump means 137 atomizes the water-ozone mixture with its internal rotor or impeller to create micro-bubbles. The micro-bubbles have an increased contact area with dirt and an improved washing efficiency, compared with the water-ozone mixture.

After exiting the rotation pump means 137, the water-ozone mixture passes through the storage tank 132 again and is directed to a washing tub lead-in apparatus 138. Of course, if ozone is not used for washing, the ozone generator 135, the ozone mixer 136, and the rotation pump means 137 are omitted and the washing water, after passing through the magnetic field mixer 134, directly enters the storage tank 132 again.

However, the present invention is also directed to a washing machine which uses ozone micro-bubbles. Ozone is used for washing because it has excellent oxidation capability, it can decompose and disinfect organic substances, it can remove odorous components, and it can accelerate the decomposition of surfactant included in detergent. The ozone is dissolved into washing water, during washing of laundry, for disinfection and sterilization of the laundry.

In order to generate such ozone, an apparatus is needed to ozonize the oxygen in the air (i.e., an ozone generator). The ozone generator uses a conventional method to separate one oxygen molecule ($O_2$) in the air into two oxygen atoms (O), which are each coupled with one other oxygen molecule, for creating ozone molecules ($O_3$).

The ozone reacts with the organic substances of the washing water for a very short period of time, due to its specific characteristics. Accordingly, it is very likely that many ozone molecules are not dissolved into the washing water. If a few of them rise to the surface and are dispersed into the atmosphere, they cause a bad odor.

In order for the ozone to stay in the washing water for a long period of time, ozone bubbles should adhere to the laundry in the washing water. However, if big bubbles are used, they do not adhere to the laundry but rise to the surface easily. In contrast, if so-called micro-bubbles are used, they do not rise to the surface easily but stay in the washing water and adhere to the laundry easily.

Figure 4:
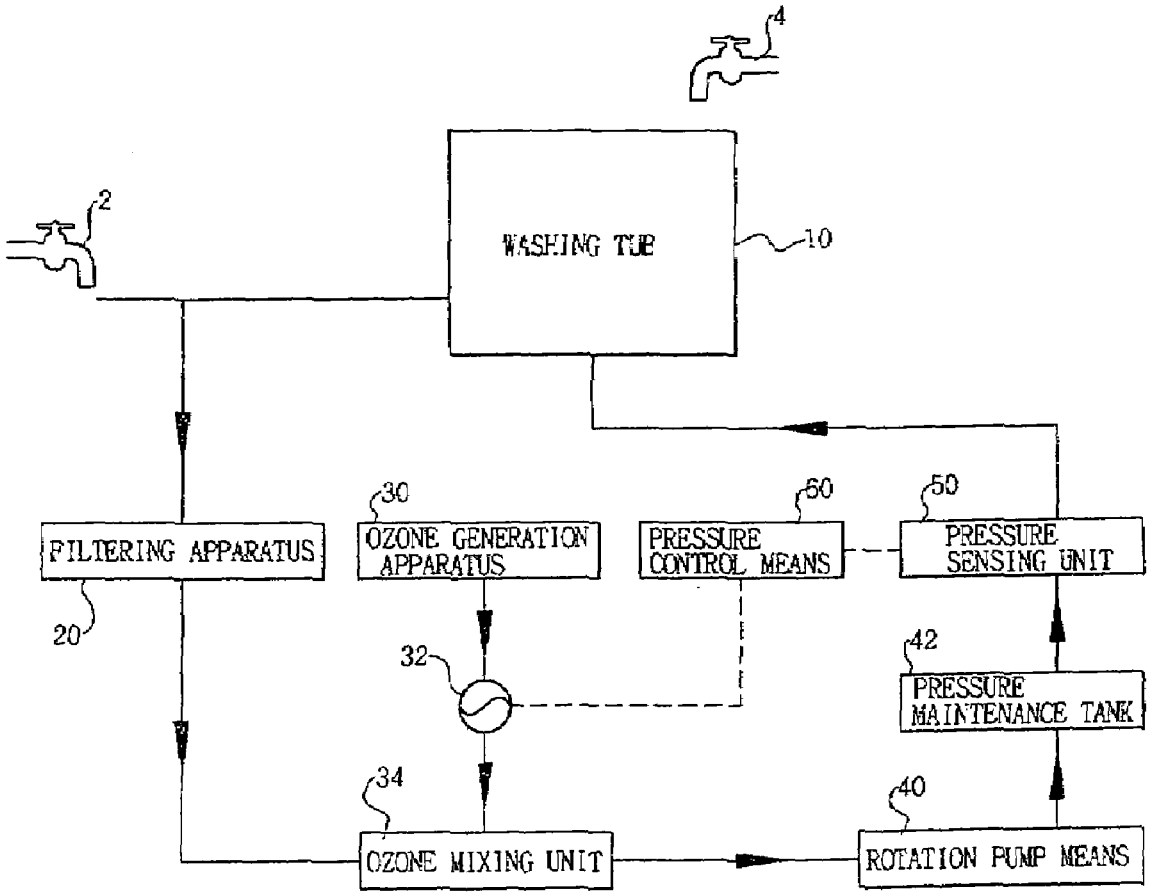
FIG. 4 is a conceptual view showing the construction of the present invention briefly.

FIG. 4 is a view conceptualizing the interconnection among respective components of the present invention. Operations thereof will now be described in brief.

Washing water is directly supplied from a water supply 2 or is first stored in a washing tub 10, which is connected to a water supply 4, and then supplied from it. The washing water then passes through a filtering apparatus 20 for removing alien substances.

After passing through the filtering apparatus, the washing water reaches an ozone mixing unit 34. The ozone mixing unit 34 is connected with an ozone generation apparatus 30 and is provided with ozone via a tube. A switching valve 32 is positioned between the ozone generation apparatus 30 and the ozone mixing unit 34 and is opened or closed by a pressure control means 60.

The washing water is mixed with ozone in the ozone mixing unit 34, creating a water-ozone mixture, and reaches a pressure sensing unit 50 via a rotation pump means 40. A tank, which has a free space of a predetermined size, is preferably provided between the rotation pump means 40 and the pressure sensing unit 50. In particular, a pressure maintenance tank 42 is preferably provided to help maintaining a predetermined pressure.

The pressure sensing unit 50 is connected with a pressure sensor (not shown) capable of measuring pressure. The pressure sensor (not shown) transmits the pressure value of the washing water, which is sensed by the pressure sensing unit 50, to the pressure control means 60. After passing through the pressure sensing unit 50, the washing water returns to the washing tub 10.

The ozone generation apparatus 30 transforms oxygen into ozone and supplies it via a small pump (not shown). As the ozone is continuously supplied from the ozone generation apparatus 30 into the ozone mixing unit 34, the pressure of the washing water, which flows through the tube, may be decreased. This causes a problem in that a high-pressure pump is needed to operate the rotation pump means 40 with higher pressure.

Accordingly, the ozone should not be supplied continuously but intermittently, while maintaining a constant pressure. In this case, micro-bubbles can be created even with a low-pressure pump.

The pressure control means 60 controls and opens the switching valve 32 if the pressure at the pressure sensing unit 50 reaches a predetermined pressure. If the switching valve 32 is opened, ozone is included in the washing water and the pressure drops.

If the pressure at the pressure sensing unit 50 drops below a predetermined pressure, the pressure control means 60 controls and closes the switching valve 32. If the switching valve 32 is closed, the pressure of the washing water rises as much as it is pressurized by the rotation pump means 40.

It has been confirmed by experiments that the switching valve 32 can be repeatedly opened and closed several times even within one second, while maintaining a constant pressure.

The micro-bubbles are created by atomizing gas bubbles within a liquid. Although a separate generation apparatus is needed to generate the micro-bubbles, the present invention uses the rotor or impeller of the rotation pump means 40 instead.

Ozone micro-bubbles are created by atomizing internal ozone bubbles by means of the rotation of a rotor or an impeller, which is needed to maintain a constant pressure. A high-pressure rotation pump is conventionally used to create micro-bubbles.

However, if a high-pressure rotation pump is used, there is a problem in that the pump is bulky and may apply excessive pressure to other components. Therefore, it is important to find a critical pressure value at which micro-bubbles are created, while using a low-pressure pump. Once the critical pressure value is known, micro-bubbles can be created even with a low-pressure pump.

It has been confirmed by experiments that 6-6.5 kgf/cm$^2$ is the lowest pressure which a low-pressure rotation pump means 40 should maintain to create micro-bubbles. If the pressure of the rotation pump means 40 goes below 6-6.5 kgf/cm$^2$, the amount of micro-bubbles created is very small and, if the pressure is above 6-6.5 kgf/cm$^2$, the amount increases drastically.

As a result, it is possible to obtain the maximum effect even with a low-pressure rotation pump means 40.

After the micro-bubbles are created by the rotor or impeller, which is used to maintain the pressure within the rotation pump means 40 above a predetermined pressure, they pass through a pressure maintenance tank 42 together with the washing water. The pressure maintenance tank 42 temporarily stores the water-ozone mixture from the rotation pump means 40 and uniformly discharges it to the pressure sensing unit 50.

The pressure sensing unit 50 is adapted to measure the pressure of the water-ozone mixture and is connected with a sensor (not shown), which transmits pressure values to the pressure control means 60.

After passing through the pressure sensing unit 50, the water-ozone mixture flows into the washing tub. In the washing tub, ozone micro-bubbles adhere to the laundry and perform the type of disinfection and sterilization which are peculiar to ozone.

Figure 5:
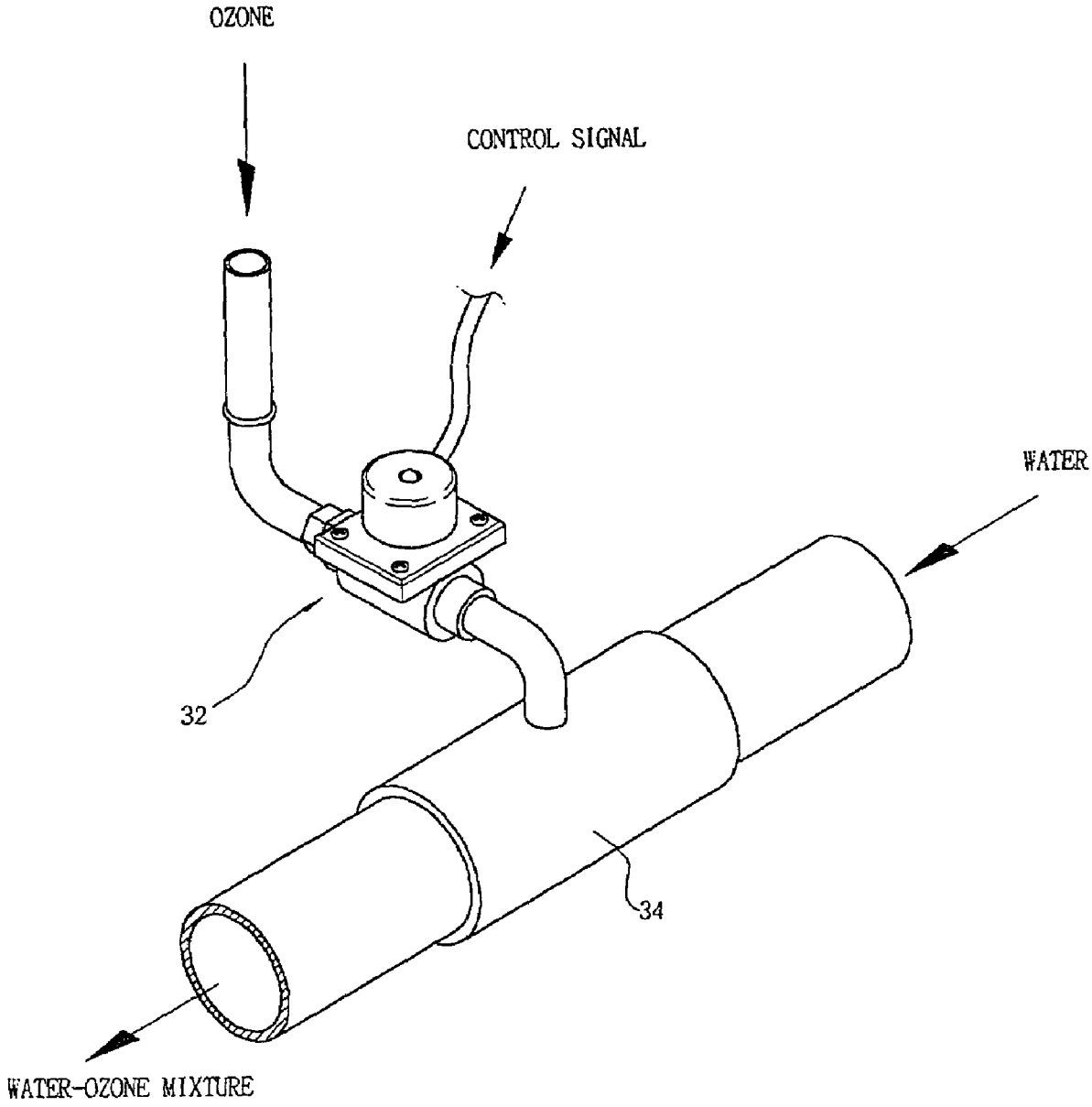
FIG. 5 shows an ozone mixing unit and a switching valve according to the present invention.

FIG. 5 shows the construction of the ozone mixing unit 34 and the switching valve 32 according to the present invention.

The switching valve 32 is electrically actuated to feed or interrupt ozone, which flows from a tube, according to a control signal from the pressure control means 60. If the switching valve 32 is opened, ozone flows into the ozone mixing unit 34 and is mixed with water to create a water-ozone mixture.

Figure 6:
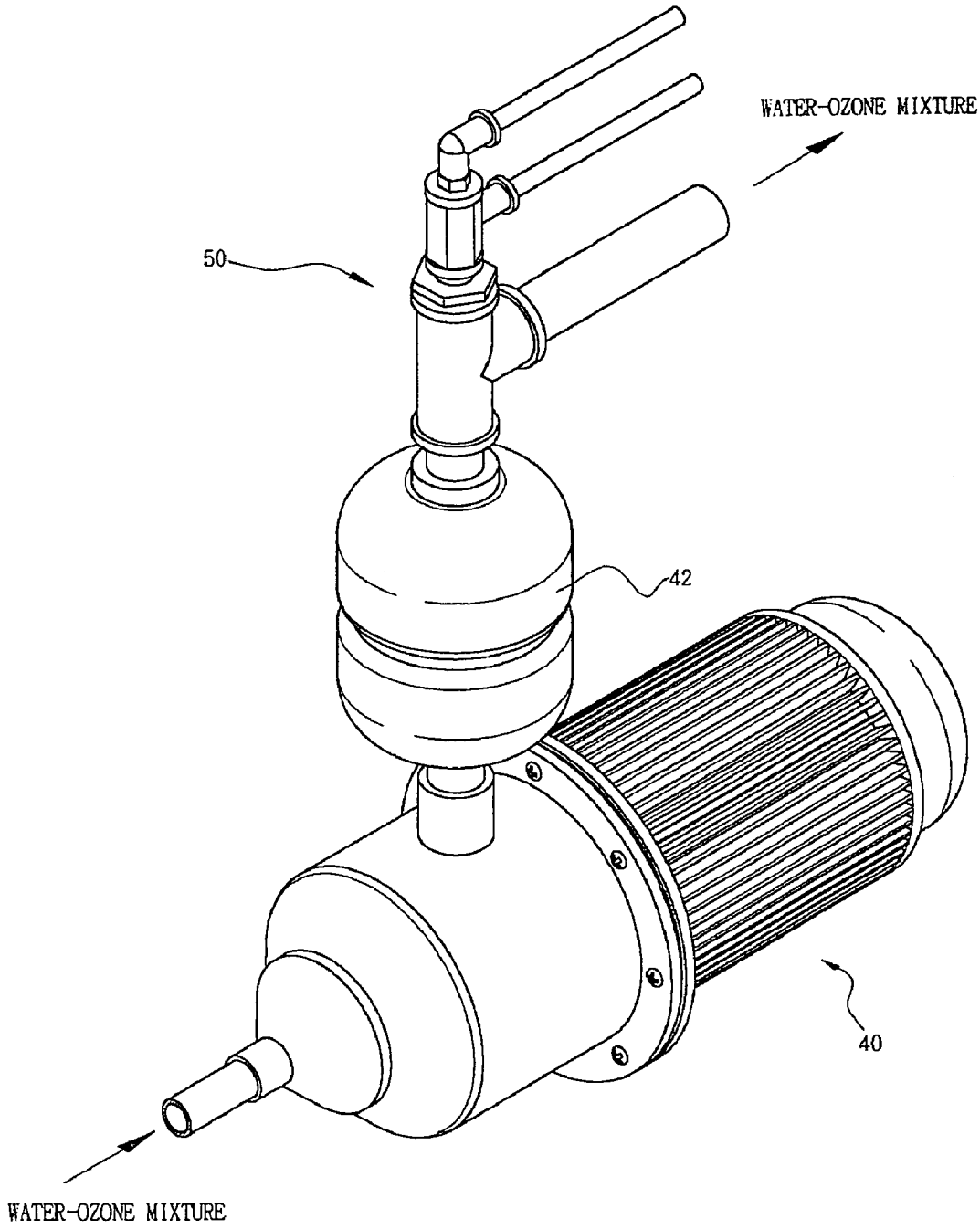
FIG. 6 shows a rotation pump means and a pressure sensing unit according to the present invention.

FIG. 6 shows the construction of the rotation pump means 40 and the pressure sensing unit 50 according to the present invention.

The water-ozone mixture flows into the rotation pump means 40 and is directed to the pressure sensing unit 50 via a pressure maintenance tank 42, which is positioned above the rotation pump means 40.

The pressure sensing unit 50 includes a pressure sensing tube 52, which is connected with a sensor (not shown), and an air discharge tube 54.

The air discharge tube 54 is opened only during the initial driving period to discharge air from tubes. If the air is completely discharged and the water-ozone mixture begins to flow in, the air discharge tube 54 is closed by a separate valve (not shown).

Figure 7:
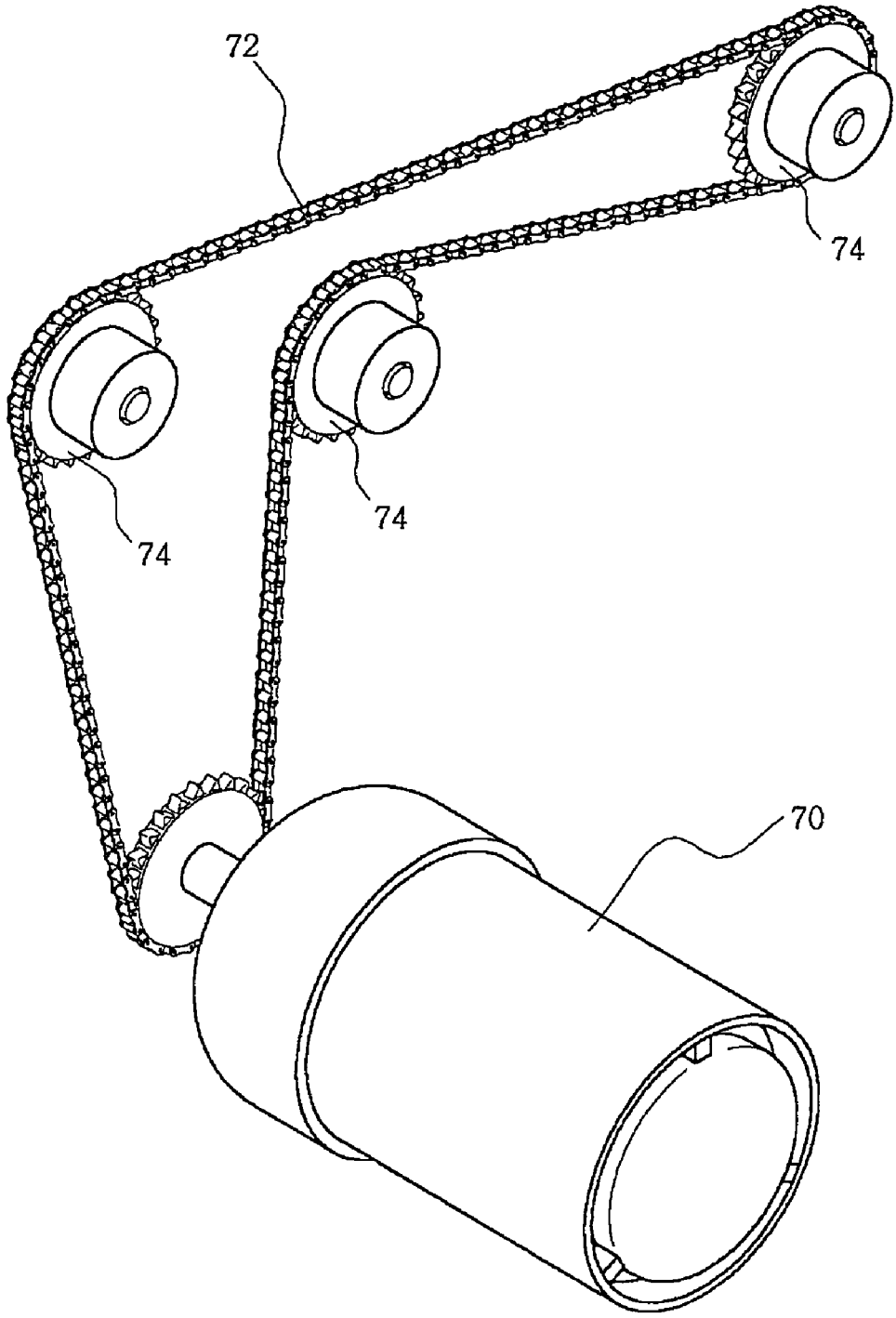
FIG. 7 shows a motor and sprockets according to the present invention.

FIG. 7 shows a motor 70 and sprockets 74 according to the present invention.

The present invention introduces a washing machine which uses the disinfection and sterilization actions of ozone micro-bubbles and which is very efficiently used to wash not only clothes in general, but also shoes, helmets, baseball gloves, roller skates, and the like. Since these items are not frequently washed, their disinfection and sterilization are considered to be more important and new washing machines have been introduced recently, which are specialized for these items.

As such, the present invention is characterized in that it is possible to add a brush, which can be rotated in the washing tub 10.

The motor 70 rotates the sprockets 74 using a chain 72. The sprockets 74 are connected with shaft couplers (not shown), which are positioned on the internal side of the washing tub 10. If the sprockets 74 are rotated, the shaft couplers are rotated accordingly.

The motor 70, the chain 72, and the sprockets 74 are positioned on the external side of the washing tub 10 and the shaft couplers (not shown) are positioned on the opposite sides within the washing tub 10.

Figure 8:
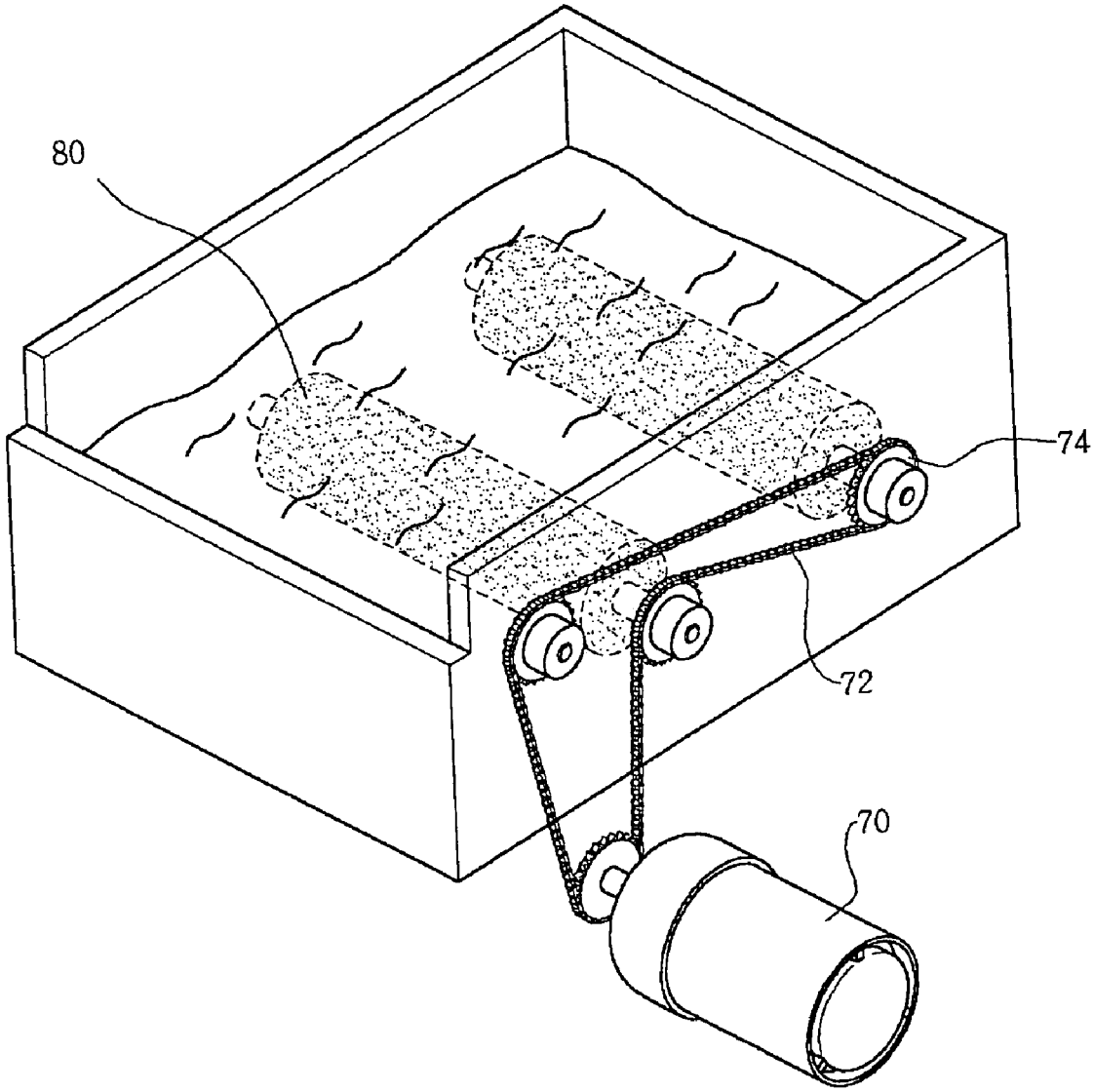
FIG. 8 shows rotational brushes, which are positioned in a washing tub, according to the present invention.

FIG. 8 shows rotation brushes 80, which are positioned in the washing tub 10, according to the present invention.

The rotation brushes 80 have their central shafts fitted into shaft couplers (not shown) for rotation. The central shafts are coupled with brushes of a uniform length on their outer peripheries.

As the rotation brushes 80 are rotated, items, such as shoes, are washed efficiently.

Meanwhile, a pressure setting means (not shown) may be positioned between the pressure sensing unit 50 and the washing tub 10, so that the sectional area of internal tubes can be adjusted to set the pressure of the water-ozone mixture in the tubes.

Figure 9:
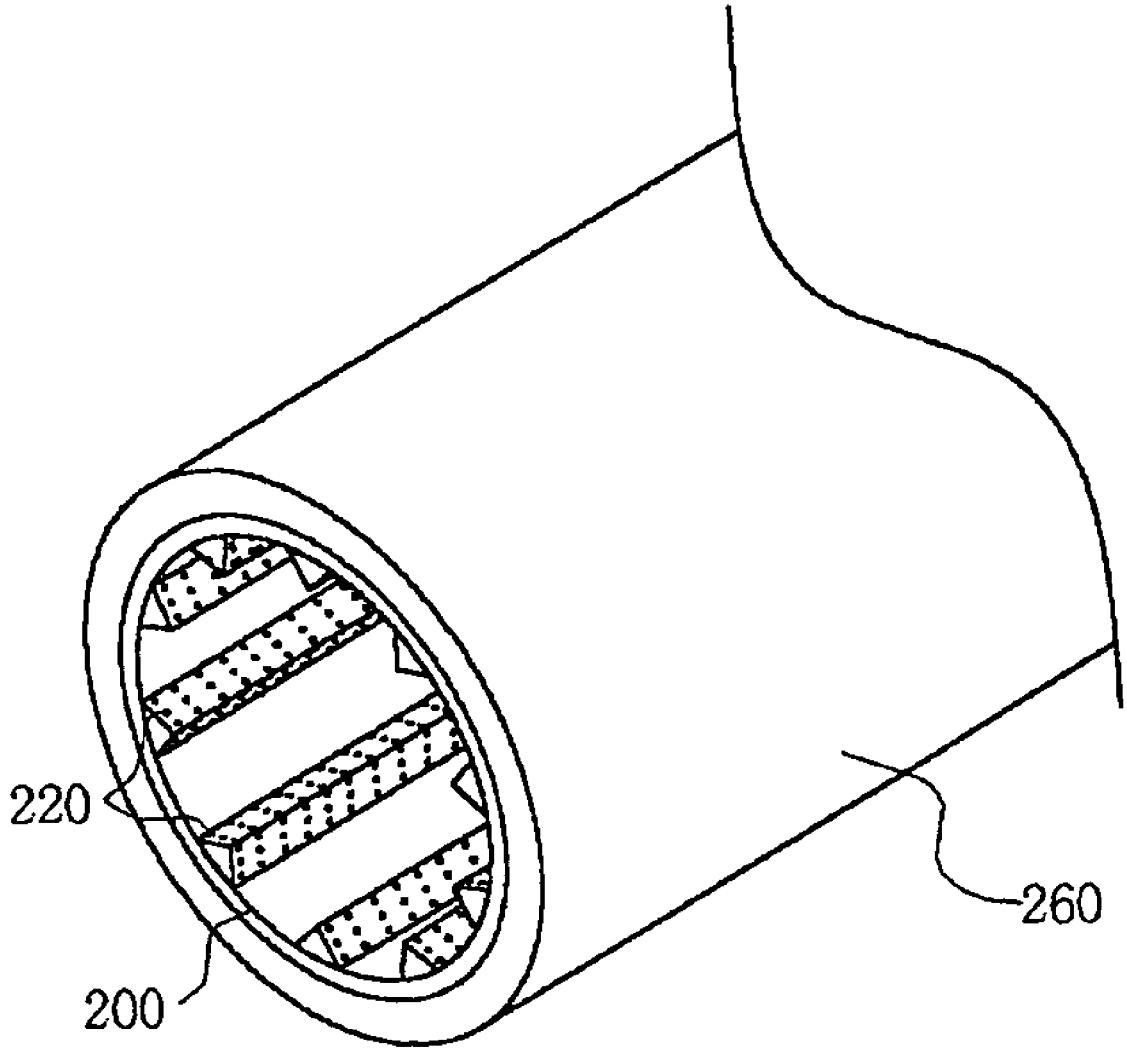
FIG. 9 shows a washing tub protrusion member, which is provided with holes and is positioned in a washing tub, according to the present invention.

FIG. 9 shows a washing tub protrusion member, which is provided with holes and is positioned in the washing tub, according to the present invention.

During draining and drying, moisture can be discharged through the holes 220, which are positioned in the washing tub protrusion member 210. This improves the draining and drying efficiencies.

Figure 10:
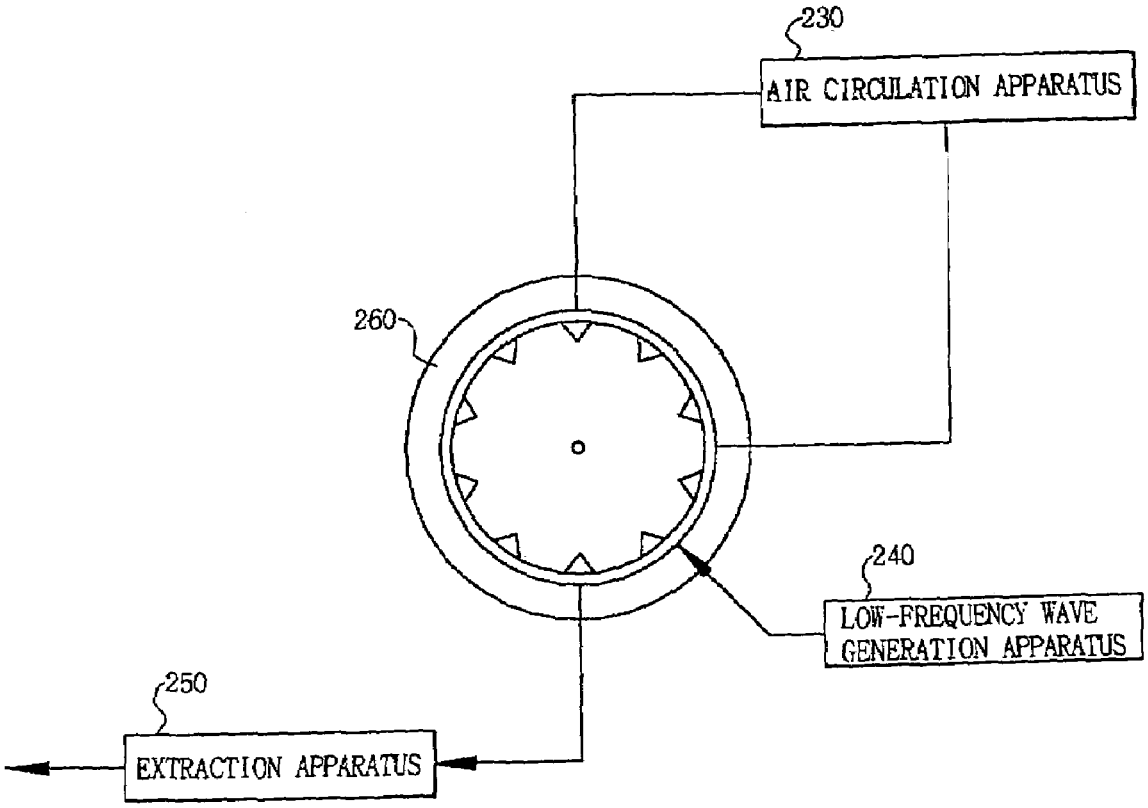
FIG. 10 shows the construction of the present invention as a drying apparatus.

FIG. 10 shows the construction of the present invention as a drying apparatus.

Referring to FIG. 10, the washing tub 200 is provided with an air circulation apparatus 230 for circulating the air within the washing tub 200, an extraction apparatus 250 for extracting moisture from the air within the washing tub, and a low-frequency wave generation apparatus 240 for generating low-frequency waves or microwaves and injecting them into the washing tub 200.

If the low-frequency waves or the microwaves are applied from the low-frequency wave generation apparatus 240 into the laundry within the washing tub 200, the moisture contained in the laundry is evaporated before the drying of the laundry itself. This minimizes damage to clothes.

Meanwhile, the lower the temperature of the laundry is, the less damage is done to clothes. However, washing is generally performed with washing water of ambient temperature. Considering this, it would be desirable to obtain similar results as when cool water (of a temperature of about 4° C.) is used for washing, even if washing is performed with washing water of ambient temperature. Accordingly, the present invention is characterized in that cool air is blown to the laundry, after washing it with washing water of ambient temperature and before drying it.

The laundry can be dried most rapidly with air having high temperature and low humidity. The air circulation apparatus 230 is included to provide high temperature and the extraction apparatus 250 is included to provide low humidity.

The air circulation apparatus 230 will now be explained.

Cool air is initially introduced into the washing tub 200 to remove a considerable portion of the moisture within the washing tub 200. The cool air is then circulated within the washing tub 200 by the air circulation apparatus 230. During this process, air molecules gain kinetic energy and thus the overall air becomes warmer. As such, the initially cool air is conditioned into high temperature for drying, by the air circulation apparatus 230. However, the temperature of the air drops again after the drying process (according to the second law of thermodynamics). After the temperature drop, the air undergoes the above process again. As a result, the air within the washing tub 200 repeatedly undergoes the process of cooling and heating through the air circulation apparatus 230.

Meanwhile, the air within the washing tub 200 is not frequently exchanged with fresh air. Accordingly, the present invention is characterized in that an anion generation apparatus is positioned on the outer surface of the washing tub 200, in order to minimize damage by dusts or viruses which may exist in the stagnant air. The anions can purify contaminated air and remove odor.

The extraction apparatus 250 will now be explained.

A washing machine can maximize its drying function when it uses dry air, the absolute humidity of which is minimized, in the washing tub 200. Therefore, the present invention extracts moisture from the air within the washing tub 200 using the extraction apparatus 250. The extraction apparatus 250 may be composed of a fan or a pump.

The present invention is also characterized in that cool water can contact the outside of the washing tub 200 right after a drying process. Accordingly, it is possible to begin washing new laundry without any delay, after the washing tub 200 has finished the drying process.

To this end, a washing water circulation apparatus 260 is coupled with the external surface of the washing tub 200 and circulates water of 4° C. around the outside of the washing tub 200 to cool it.

Meanwhile, the washing apparatus and the drying apparatus, described as above, may be integrated to each other or may be provided separately.

The present invention is advantageous as follows:

Bubbles are created by ozone and are used in washing for enhanced disinfection and sterilization.

The ozone bubbles can be created without any additional bubble generation means.

Ozone micro-bubbles can be created without a high-pressure rotation pump means.

The ozone micro-bubbles can be easily generated even with a low-pressure rotation pump means, by maintaining a critical pressure at which the micro-bubbles are generated.

Rotational brushes are provided in the washing tub and make it easy to wash, for example, shoes.

Washing water passes through a washing water supply means, before being introduced into the washing tub, for optimized washing.

Holes are formed in the washing tub protrusion member, which is fastened in the washing tub, so that moisture can be efficiently removed from the laundry during draining and drying processes.

An air circulation apparatus and an extraction apparatus condition the air within the washing tub for more efficient drying.

Although a preferred embodiment of the present invention has been described for illustrative purposes, those skilled in the art will appreciate that various modifications, additions and substitutions are possible, without departing from the scope and spirit of the invention as disclosed in the accompanying claims.

The invention claimed is:

1. A washing machine, comprising:

a washing water supplier supplying washing water to a washing tub, the washing water supplier comprising:

an auxiliary storage tank connected to a tap water pipe to receive washing water from the tap water pipe and storing the washing water;

a washing tub lead-in apparatus connected to the washing tub and controlling the amount of the washing water flowing into the washing tub; and a washing water storage apparatus connected to the auxiliary storage tank and the washing tub lead-in apparatus to receive the washing water from the auxiliary storage tank and supply the washing water to the washing tub lead-in apparatus, the washing water storage apparatus comprising:

a leveling apparatus connected to the auxiliary storage tank and adjusting the amount of washing water flowing from the auxiliary storage tank;

a storage tank connected to the leveling apparatus and storing the washing water;

a quick cooler connected to the storage tank and decreasing the temperature of the washing water supplied from the storage tank;

a magnetic field mixer connected to the quick cooler and endowing the washing water with polarity;

an ozone generator for generating ozone;

an ozone mixer connected to both the ozone generator and the magnetic field mixer to mix the ozone from the ozone generator with the washing water from the magnetic field mixer into a water-ozone mixture; and a rotation pump connected to the ozone mixer and atomizing the ozone of the water-ozone mixture to generate micro-bubbles; and the washing tub connected to the washing water supplier via the washing tub lead-in apparatus, the washing tub comprising a washing apparatus for washing laundry, a draining apparatus for draining the washed laundry, and a drying apparatus for drying the drained laundry.

* * * * *